United States Patent [19]

Paulsson et al.

[11] Patent Number: 4,622,788

[45] Date of Patent: Nov. 18, 1986

[54] BUILDING STRUCTURE, ESPECIALLY AIR RAID SHELTER

[75] Inventors: Jan-Erik H. Paulsson, Malmö ; Lars-Göran F. Blixt, Lyckeby, both of Sweden

[73] Assignee: Lars-Göran Franklin Blixt, Lyckeby, Sweden

[21] Appl. No.: 486,293

[22] PCT Filed: Aug. 5, 1982

[86] PCT No.: PCT/SE82/00254

§ 371 Date: Apr. 4, 1983

§ 102(e) Date: Apr. 4, 1983

[87] PCT Pub. No.: WO83/00522

PCT Pub. Date: Feb. 17, 1983

[30] Foreign Application Priority Data

Aug. 7, 1981 [SE] Sweden ..... 8104738

[51] Int. Cl.[4] ..... E04H 9/04; E04B 1/343

[52] U.S. Cl. ..... 52/79.11; 52/227; 52/169.6; 52/438

[58] Field of Search ..... 52/227, 79.9, 79.13, 52/79.14, 79.7, 79.1, 79.11, 169.6, 425, 429, 438, 442

[56] References Cited

U.S. PATENT DOCUMENTS

| | | | |
|---|---|---|---|
| 3,468,081 | 9/1969 | Saarinen | 52/79.13 |
| 3,514,910 | 6/1970 | Comm | 52/79.14 |
| 4,073,100 | 2/1978 | DiGiovanni, Jr. | 52/79.9 |
| 4,107,886 | 8/1978 | Ray et al. | 52/79.11 |
| 4,129,969 | 12/1978 | Haapala | 52/79.9 |
| 4,159,602 | 7/1979 | Polack | 52/227 |
| 4,228,623 | 10/1980 | Menosso | 52/79.9 |

FOREIGN PATENT DOCUMENTS

| | | |
|---|---|---|
| 72261 | 2/1976 | Australia . |
| 1137545 | 10/1962 | Fed. Rep. of Germany . |
| 488013 | 7/1938 | United Kingdom . |

*Primary Examiner*—John E. Murtagh

*Attorney, Agent, or Firm*—Beveridge, DeGrandi & Weilacher

[57] ABSTRACT

A building structure, especially an air raid shelter is formed from prefabricated tubular concrete elements (10) and end wall elements (11), the tubular concrete elements (10) being clamped between the end wall elements (11) with the aid of prestressed prestressing means or ties (12). The tubular concrete elements (10) have at least one stiffening beam (17, 18) extending all around them and at least the interstices between successive stiffening beams are filled with in situ cast concrete (13) reinforced by means of a crossbar (24), which in situ cast concrete encloses the prestressed prestressing means or ties (12). Two or more rows of tubular concrete elements (10) with end wall elements (11) can be placed beside each other to form a large building structure, especially an air raid shelter in which the stiffening beams (17) on the adjoining tubular concrete elements (10) engage each other in a comb-like manner and constitute columns.

16 Claims, 14 Drawing Figures

BUILDING STRUCTURE, ESPECIALLY AIR RAID SHELTER

This invention relates to a building structure, especially an air raid shelter, comprising a number of adjoining, prefabricated, reinforced, tubular concrete elements and end wall elements clamped together with the aid of prestressing means. Such air raid shelters are previously known for instance from DE-AS 1,137,545. However, the prior art air raid shelter suffers from great drawbacks inasmuch as it has been produced from numerous, relatively small elements and therefore in mounted state has a great many weakened joints. In order that an air raid shelter produced from prefabricated elements shall satisfy the high requirements that of necessity are nowadays placed on air raid shelters, the air raid shelter must be so constructed that the joints between the prefabricated elements are tight, that the cohesion between the elements is of such a nature that the joints do not imply any weakening compared with an in situ produced or cast air raid shelter structure, and the air raid shelter produced from prefabricated elements must possess a sufficient deformability, stability and energy absorption to display the same strength and stability as do in situ produced or cast air raid shelters. The prior art air raid shelter structure disclosed by DE-AS 1,137,545 cannot satisfy these requirements. The same applies to other prior art air raid shelters which have wholly or partly been formed by prefabricated elements, such as the air raid shelter according to DE-AS 1,052,102. The lack of stability and strength is still more evident in another prior art type of air raid shelter which has been formed by prefabricated elements, namely the air raid shelter according to DE-AS 1,005,260.

The object of the present invention is to provide a building structure, especially an air raid shelter which fulfils the above-mentioned requirements and, moreover, can be produced from large prefabricated elements which are readily handled in spite of their size. This and other objects of the invention are realized if the building structure, especially the air raid shelter, is given the characteristic features indicated in the appended main claim. In the building structure, especially the air raid shelter according to the invention, the tubular concrete elements shall thus exteriorly and/or interiorly have at least one stiffening beam and said stiffening beam shall be formed with holes for prestressing means or ties to pass through, with the aid of which means or ties the tubular concrete elements are clamped together between the end wall elements. Besides, at least the interstices between the stiffening beams of the adjoining concrete elements shall be filled out with reinforced in situ cast concrete for permanent interconnection of the concrete elements and embedding of the prestressing means or ties so as to provide a structure similar to prestressed concrete.

In a particularly advantageous embodiment of the invention the building structure, especially the air raid shelter, can comprise several adjoining rooms each of which has a set of delimiting tubular concrete elements. In this case the stiffening beams of the tubular concrete elements of adjoining rooms are offset relative to each other and engage in a comb-like manner with each other. A longitudinal, reinforced stiffening beam formed of in situ cast concrete is in this case provided at the top and optionally also at the bottom between adjoining sets of tubular concrete elements. In this embodiment of the invention the adjoining rooms of the building structure, especially the air raid shelter, will thus be interconnected via a number of openings defined by columns of which each column is thus formed by two adjacent stiffening beams of which one stiffening beam belongs to the tubular concrete elements of one room while the other stiffening beam belongs to the tubular concrete elements of the other room.

It is of particular advantage if the stiffening beams of the tubular concrete elements are placed exteriorly on the top and side faces of the concrete elements, but placed interiorly at the bottom of the concrete elements. As a result, the underside of the concrete elements can be made planar and moreover it will be easier to place the concrete elements on a levelled base.

If the building structure, especially the air raid shelter, is formed by substantially square or rectangular tubular concrete elements it is recommended to place the prestressing means or ties in the region of the corners of the concrete elements. If need be, the prestressing means or ties may however be placed also between the corner portions.

The individual tubular concrete elements are so dimensioned that each element can withstand the loads determinative of the dimensions of the building construction or air raid shelter. The finished building or air raid shelter structure which thus comprises the prefabricated concrete elements and reinforced in situ cast concrete, can take up very large stresses because the joining together of the individual elements will be very effective by reason of the reinforced in situ cast concrete and because the reinforcement of the in situ cast concrete serves as a stress-distributing crossbar and makes it possible to space the stiffening beams a large distance apart without resulting in an unpermissible weakening of the structure.

In an embodiment of the invention, the reinforcement of the in situ cast concrete may have its longitudinal reinforcing means passed through through-holes in the stiffening beams of the tubular concrete elements, but in another embodiment of the invention, the reinforcement may also have been placed outside the stiffening beams in an in situ cast concrete layer which encloses them. In the latter case the stiffening beams on the outer side of the tubular concrete elements may preferably have protruding lugs for the fixation of forms for the in situ casting of concrete.

As mentioned in the foregoing it is essential that the cohesion between the prefabricated concrete elements is such that joints do not imply any weakening compared with an in situ produced building or air raid shelter structure. To be sure that such a cohesion is realized it is recommended, in a particularly advantageous embodiment of the invention, to provide the end surfaces of the tubular concrete elements with two defining flanges which protrude differently far and define an annular groove. On in situ cast concreting, said groove is then filled with in situ cast concrete which is preferably reinforced so that said preferably reinforced in situ cast concrete forms a locking tongue. To realize this the defining flange closest to the stiffening beam of the concrete elements shall be the shortest, while the adjoining concrete element should have its longer defining flanges placed close to each other. Moreover, the peripheral edge of the end wall elements should be enclosed by reinforced in situ cast concrete at least within the areas where the prestressing means are anchored in the end wall elements.

The invention will be more fully described below in connection with air raid shelters and with reference to some embodiments illustrated in the accompanying drawings in which.

Figure 3:
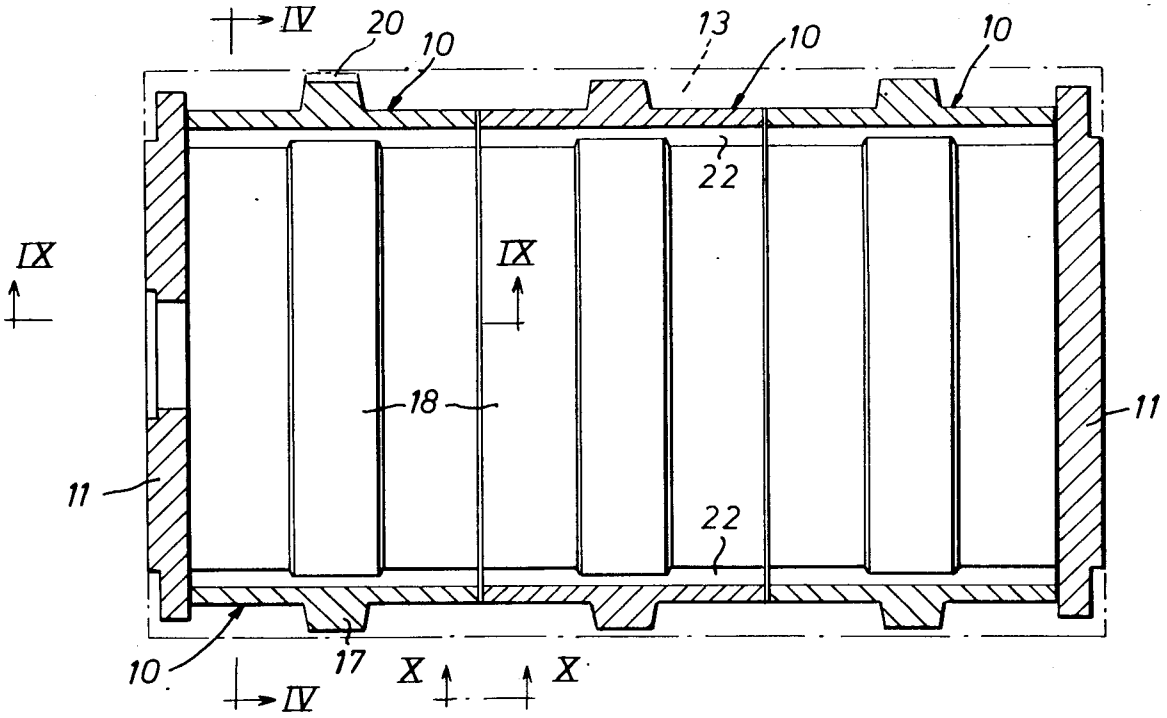
FIG. 3 is a diagrammatic horizontal section of a second embodiment of an air raid shelter according to the invention.
Figure 4:
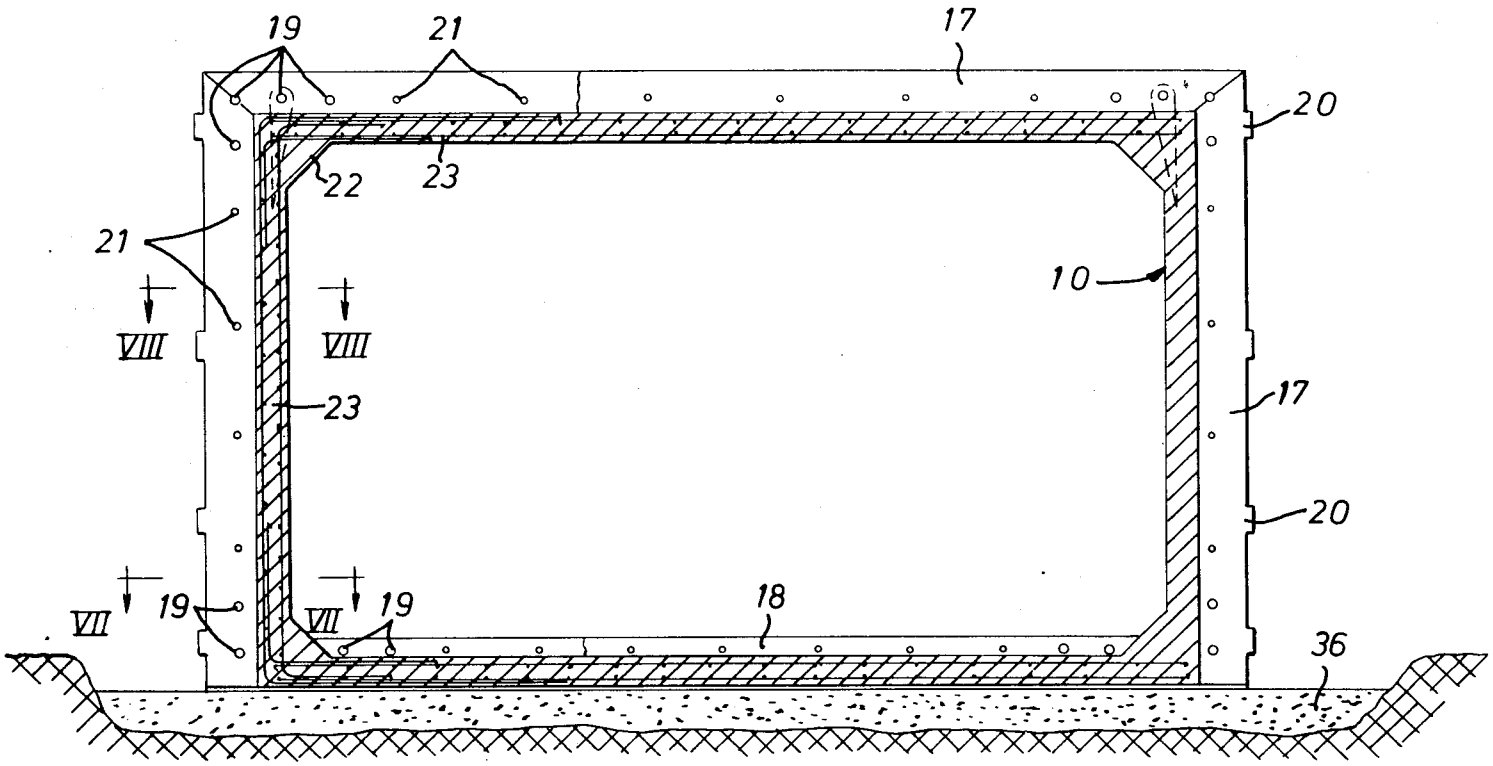
FIG. 4 is a vertical section on line IV—IV in FIG. 3.
Figure 5:
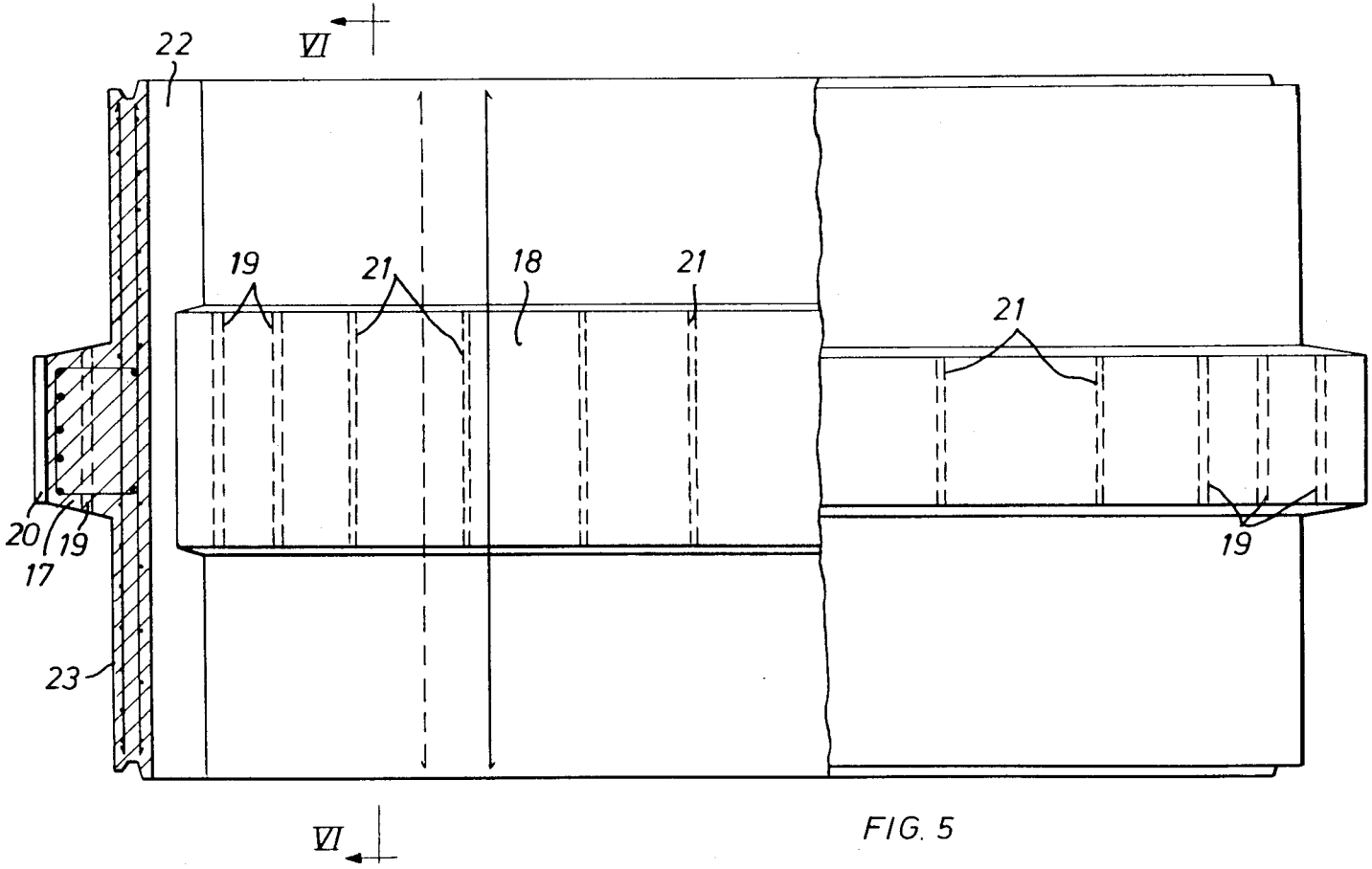
Figure 6:
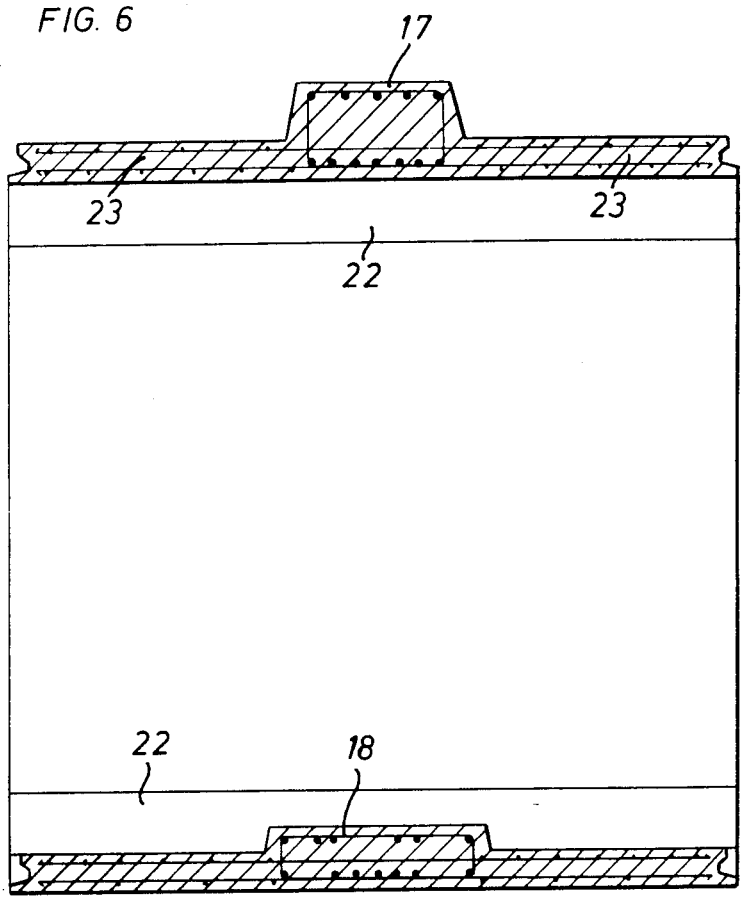
Figure 7:
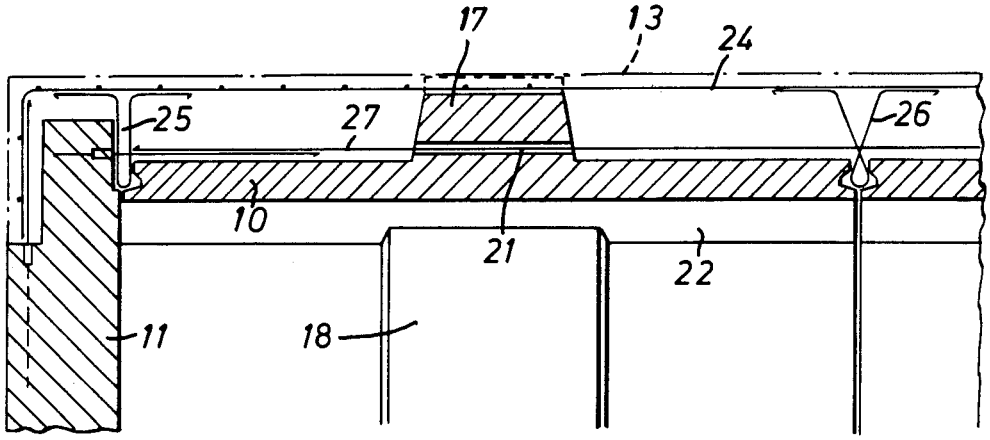
Figure 8:
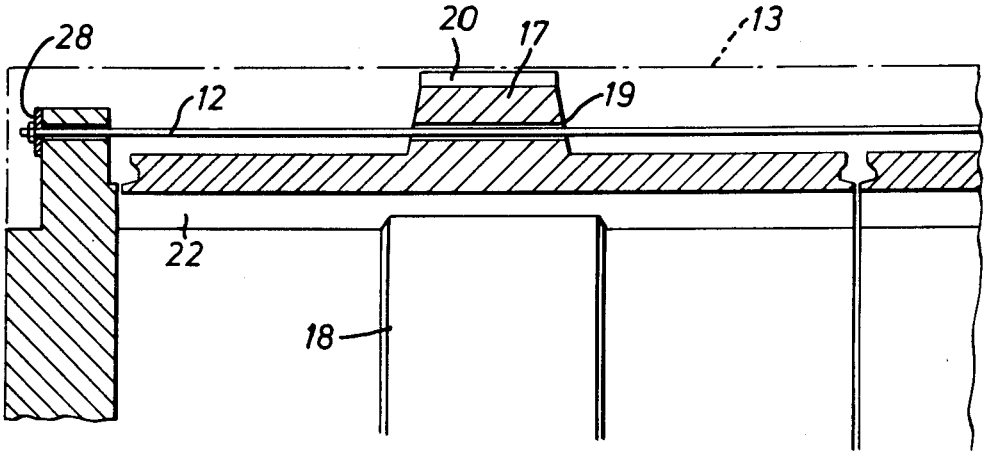
Figure 10:
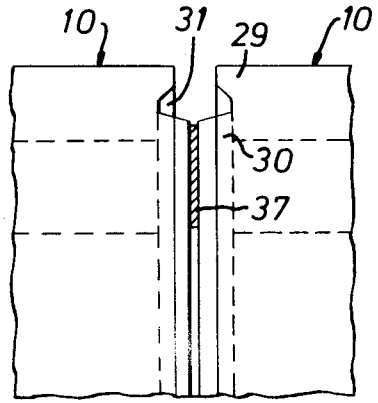
Figure 9:
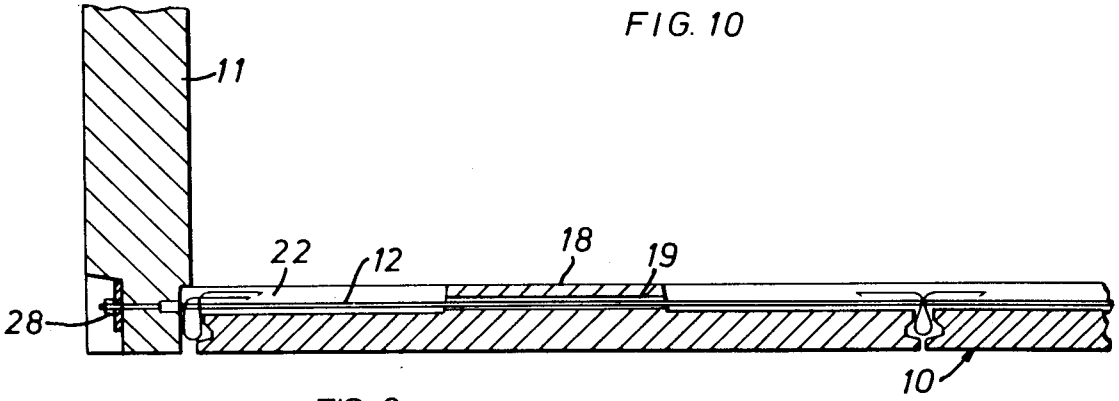
Figure 11:
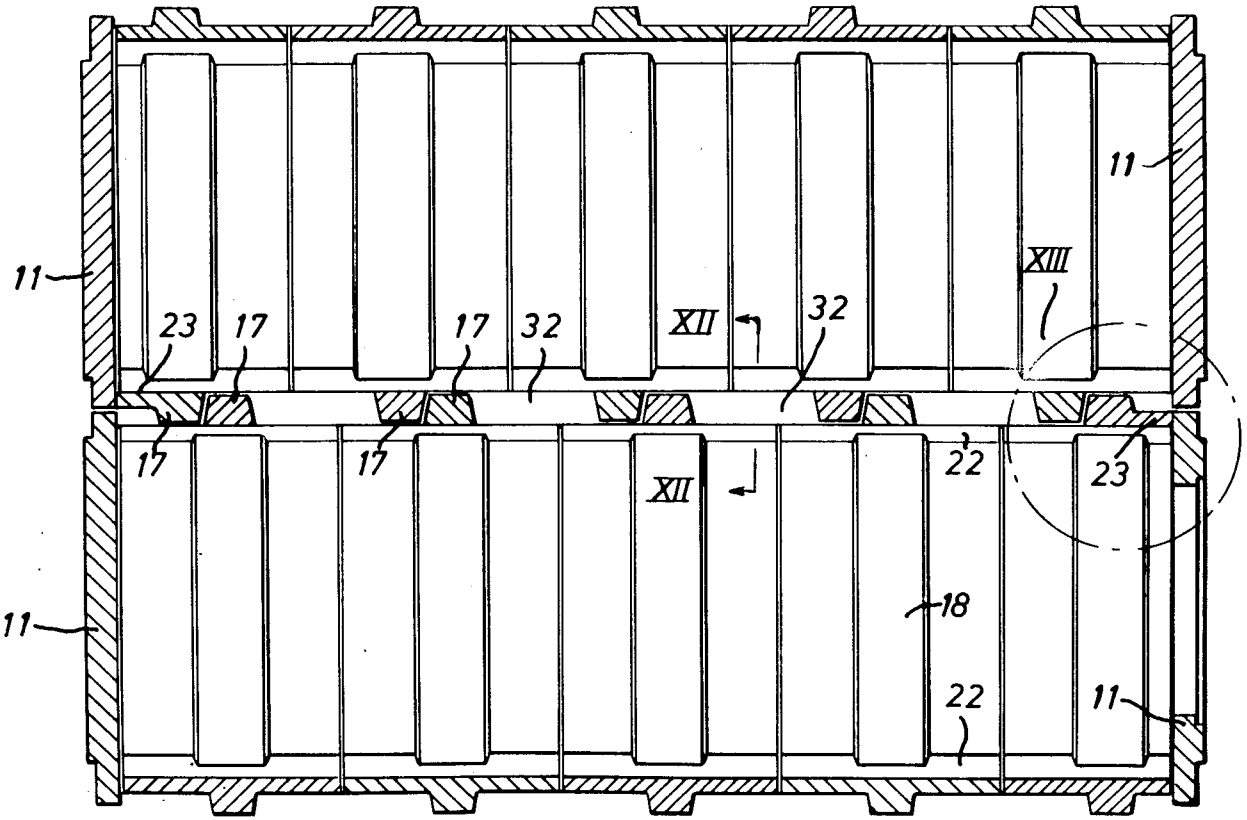
Figure 12:
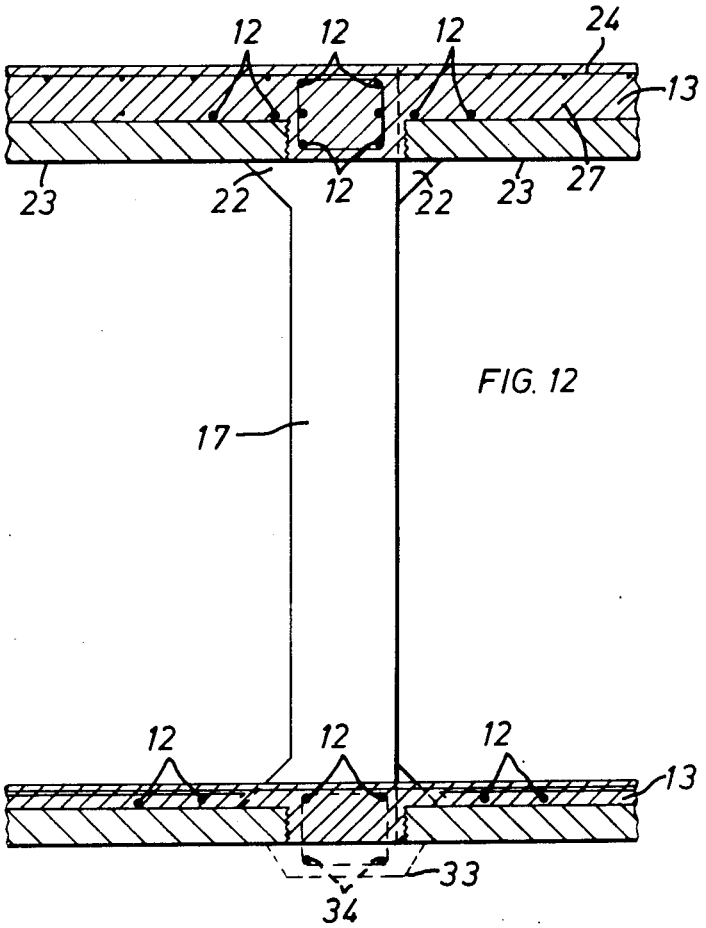
Figure 14:
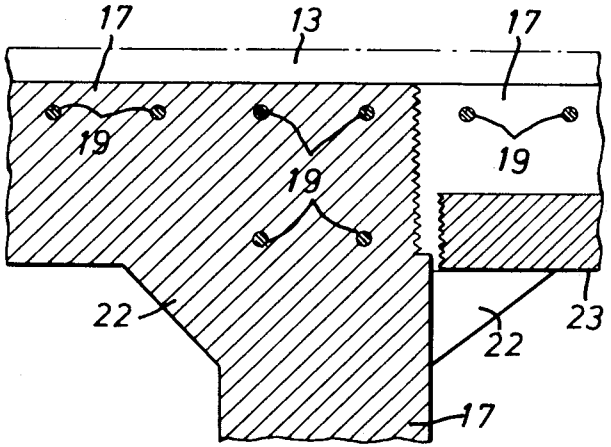
Figure 13:
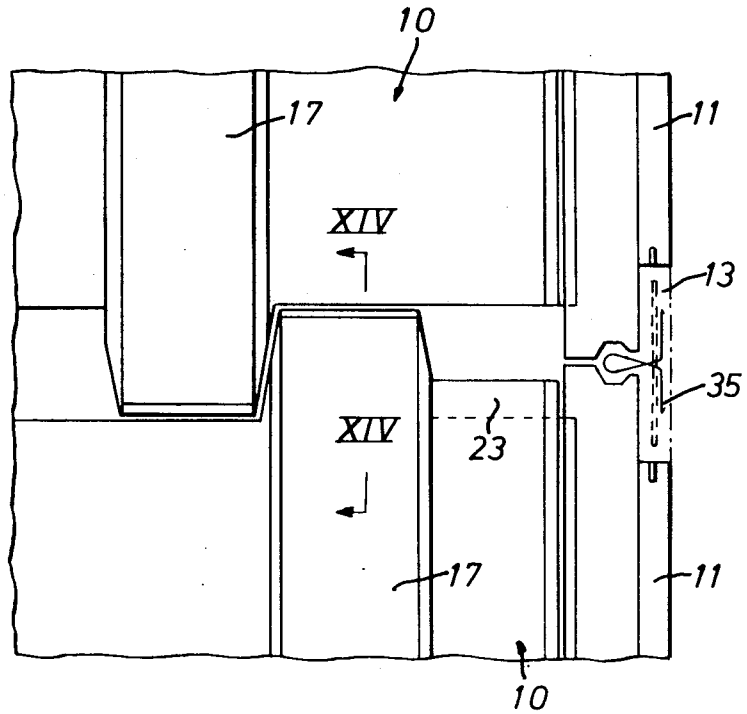

FIG. 5 partly in section and partly in plan view shows a tubular building element of the air raid shelter;

FIG. 6 is a section on line VI—VI in FIG. 5;

FIG. 7 is a section on line VII—VII in FIG. 4;

FIG. 8 is a section on line VIII—VIII in FIG. 4;

FIG. 9 is a section on line IX—IX in FIG. 3;

FIG. 10 is a partial side view on line X—X in FIG. 3;

FIG. 11 shows a further embodiment of an air raid shelter according to the present invention;

FIG. 12 is a section on line XII—XII in FIG. 11 after the in situ concreting operation;

FIG. 13 is a plan view of the area XIII in FIG. 11 before the in situ concreting operation; and FIG. 14 is a section on line XIV—XIV in FIG. 13.

Figure 1:
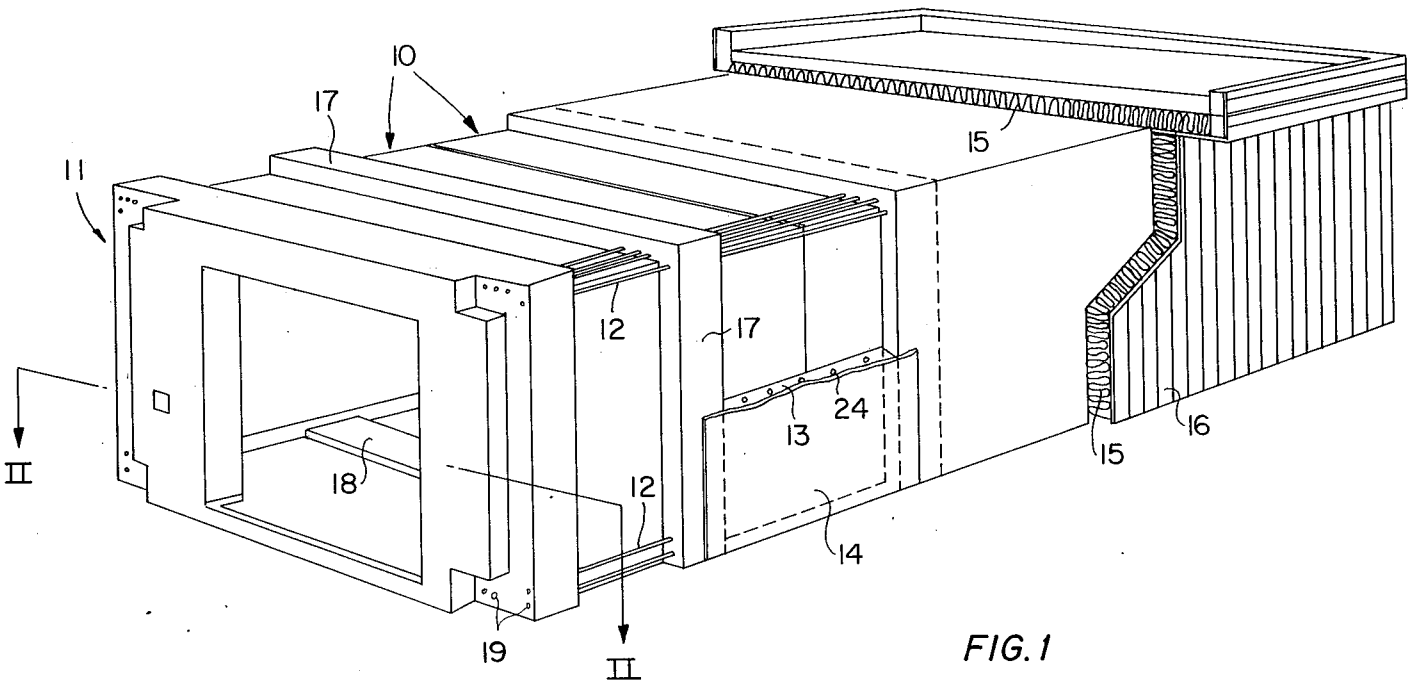
FIG. 1 is a diagrammatic sketch showing a perspective view of an embodiment of an air raid shelter according to the invention.
Figure 2:
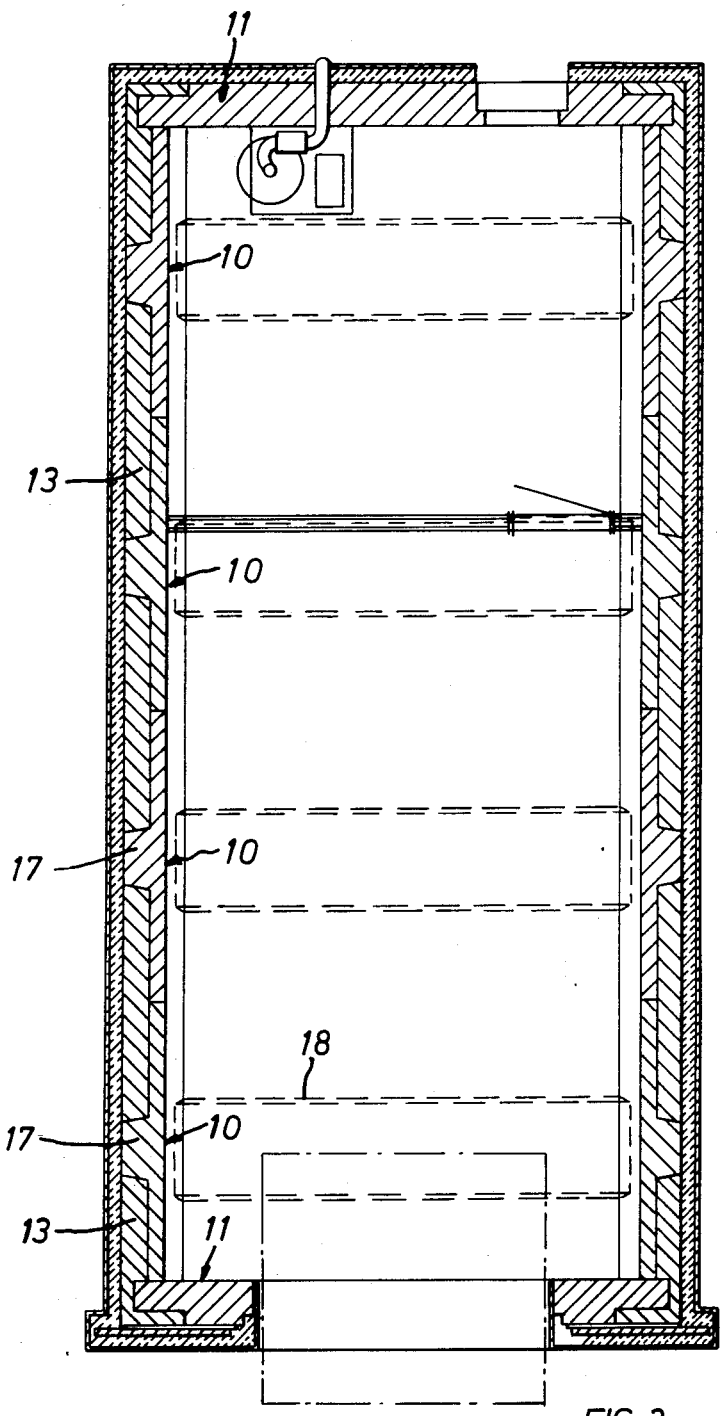
FIG. 2 is a section on line II—II in FIG. 1 after the air raid shelter has been finished.

As will appear from FIGS. 1 and 2, an air raid shelter according to the present invention can be in the form of a detached building which may serve in peace time for instance as a garage. Alternatively, the air raid shelter may be a store-room of a building or be parts of a basement of a building, say a detached house or apartment building.

As will appear from FIGS. 1 and 2, an air raid shelter according to the invention is constructed from a number of tubular, reinforced concrete elements 10 and end wall elements 11 at the ends of the row of tubular concrete elements. The tubular concrete elements 10 are clamped between the end wall elements 11 with the aid of a number of prestressing means or ties 12, in the present instance four such prestressing means at each corner. The prefabricated concrete elements which may have a length of about 2.5 m, a width of about 4.5 m and a height of about 2.6 m and may weigh 10 to 12 tons, are besides united by means of reinforced in situ cast concrete 13. Said in situ cast concrete 13 is cast between the concrete elements 10, 11 and exteriorly fastened plate forms 14. In the illustrated embodiment the garage building or air raid shelter building has been supplemented with a heat insulation 15 and a facing 16 on the walls and the roof. The stationary air raid shelter equipment 38 is preferably concreted in an end wall element 11.

According to the invention, the tubular concrete elements have a stiffening beam which extends all around them and which in the embodiment illustrated has its parts 17 placed on the outer side of the tubular concrete elements, while the part 18 of the stiffening beam is placed on the inner side of the concrete element. This will be seen from FIGS. 1 and 2, where FIG. 1 in its left-hand portion shows the elements before the in situ concreting of the concrete layer 13 and a floor concrete layer.

As more closely described in conjunction with the embodiment according to FIGS. 3–10 the tubular concrete elements 10 and the end wall elements 11 are provided with holes 19 for the prestressing means or ties 12 to pass through. As a result, the concrete elements 10 can be clamped between the end wall elements 11. At the in situ concreting of the concrete layers 13 the prestressing means 12 will be wholly enclosed by concrete and will remain therein as a type of prestressing steel, even if said prestressing steel should not be included in the calculations of strength of the structure. As already mentioned the in situ cast concrete also has a reinforcement 24 which is only hinted at in FIGS. 1 and 2, but which serves as a crossbar which shall distribute the stresses at the joints between the individual concrete elements and distribute them in the longitudinal direction of the elements so that the joints will not imply any impermissible weakening of the air raid shelter structure.

The embodiment of the invention illustrated in FIGS. 3–10 differs from that in FIG. 1 mainly in view of the positioning of the crossbar in the structure. In the embodiment according to FIGS. 1 and 2, the crossbar 24 is placed between the stiffening beams 17, 18 although part of said crossbar may have been passed through holes in said stiffening beams. In the embodiment according to FIGS. 3–10 the major part of the crossbar 24 has been passed outside of the stiffening beams 17 on the two side walls of the air raid shelter and in the roof thereof, the major part of the stiffening beams being enclosed in an in situ cast concrete layer 13 which is of the requisite thickness to embed the crossbar.

FIG. 3 shows a horizontal section of three concrete elements 10 which have been placed after one another on a levelled base 36 (FIG. 4) and which differ from the concrete elements 10 in FIGS. 1 and 2 only in regard of the existence of protruding fastening lugs 20.

In addition to the holes 19, the concrete elements 10 are provided with a number of holes 21 (FIG. 4) through which pass some reinforcement bars 27 of a non-tensioned reinforcement 24–27 which is more fully described in the following. AT the corners the concrete elements have been strengthened by means of fillets 22. As will appear from the section in the left-hand portion of FIG. 4 and from the section in FIG. 6 there is a strong reinforcement in the wall portions 23 and the stiffening beams 17, 18.

In FIGS. 4–6 the in situ cast concrete has been wholly omitted, while the outer defining line of the in situ cast concrete has been marked by dash and dot lines in FIGS. 3 and 7–9.

FIG. 7 which is a horizontal section on line VII—VII in FIG. 4, shows how the crossbar 24–27 has been placed and anchored in the walls of the air raid shelter. It thus appears from the Figure that said crossbar has a welded mesh reinforcement 24 which extends around the corners and emerges at the outside of the end wall elements 11 passing between the lugs 20 of the stiffening beams 17. The crossbar also comprises stirrups 25, 26 which protrude into the joint areas between adjoining concrete elements 10, 11. Besides, the crossbar comprises reinforcement bars 27 which have been passed through the holes 21 and anchored at their ends in the end wall elements 11.

The anchorage of the prestressing means in the air raid shelter structure is shown in detail in FIG. 8. It thus appears from this Figure that the prestressing means 12 extend through the holes 19 and have been anchored by means of washer and nut 28 on the outer side of the end wall elements 11. The same fastening method has been exploited to anchor the prestressing ties 12 which are provided in the floor and extend through the stiffening beams 18 (see FIG. 9).

In a particularly advantageous embodiment of the invention the tubular concrete elements have been formed in their end surfaces with two defining flanges 29, 30 which protrude differently far so as to define in said end surfaces an annular groove 31. The flange 29 located on the same side of the concrete element as the stiffening beam 17, 18 is shorter than the other flange 30 so that the two facing grooves of adjoining concrete elements can be filled with in situ cast concrete to form a locking tongue which aids in preventing a lateral displacement of the concrete elements in relation to each other. A washer 37 may be placed in the corner areas of the concrete elements.

It will be seen from FIGS. 3–10 that the finished air raid shelter will have a very great structural strength because of the stiffening beams 17, 18 and the crossbar 24–27 in the in situ cast concrete. To improve the bond between the prefabricated elements and the in situ cast concrete the surfaces of the prefabricated elements to be connected together may have been given a certain roughness. As the in situ cast concrete extends around the edge portions of the end wall elements at least in the region of the prestressing means or ties 12, there is obtained a particularly good structural strength in the corner portions.

A special and advantageous embodiment of the invention is shown in FIGS. 11–14. This embodiment is intended especially for large air raid shelters where the span would otherwise become too large to permit the prefabricated concrete elements to be handled in an acceptable manner. In the embodiment according to FIGS. 11–14 two sets of tubular elements 10 have thus been placed beside one another and interconnected. These tubular elements 10 differ from the tubular elements according to the embodiments earlier described in that parts of the wall portions 23 in the facing walls of the two sets have been omitted, while retaining only the stiffening beam portions 17. This will be clearly seen from FIG. 11 which shows a horizontal section of the prefabricated concrete elements of the air raid shelter before the in situ concreting and before the supply of the requisite reinforcement and prestressing ties. It thus appears from the Figure that the stiffening beams 17 on the two rows of concrete elements engage each other in a comb-like manner under formation of columns and leaving through-openings 32 at certain points.

The two rows of concrete elements 10 are clamped between the end wall elements 11 in the same way as in the embodiments earlier described. However, two of the prestressing ties 12 in the wall portion common to the two rows have been omitted for lack of space. However, they can still be utilized but in such a case one has to accept a threshold between the two air raid shelter portions.

FIG. 12 which is a section on line XII—XII in FIG. 11, illustrates the reinforcement of the in situ cast concrete and shows the air raid shelter after said in situ concreting operation. It thus appears from the Figure that some of the prestressing ties 12 are utilized as a reinforcement in longitudinal beams in the roof and floor in the area between the two air raid shelter columns. It further appears that the crossbar 24–27 extends over both air raid shelter portions. If desired, use may optionally be made of the thickened portion 33 shown by dash lines, which in such a case may have a longitudinal reinforcement 34 which together with the prestressing ties 12 forms a reinforcement in the resulting longitudinal beam.

FIGS. 13 and 14 show details of this embodiment and illustrate how the two adjoining end elements for the sets of tubular concrete elements can be interconnected with the reinforcement 35 and the in situ cast concrete 13. FIG. 14 in more detail shows how the joint region between the prefabricated tubular concrete elements of the two adjoining air raid shelter portions is arranged.

We claim:

1. An air raid shelter comprising a number of adjoining, prefabricated, reinforced, tubular concrete elements (10) and end wall elements (11) clamped together with the aid of prestressing means (12), wherein each of the tubular concrete elements (10) has at least one exteriorly, interiorly or both exteriorly and interiorly protruding, reinforced stiffening beam (17, 18) integral with the remaining concrete element and having holes (19) formed in the axial direction of the tubular concrete elements for the prestressing means (12) to pass through, which prestressing means are anchored to the end wall elements and serve to clamp together the tubular concrete elements (10) between the end wall elements (11), and wherein interstices are formed between the stiffening beams (17, 18) of adjoining concrete elements (10, 11) and said interstices are filled with reinforced in situ cast concrete (13) for permanent interconnection of the concrete elements (10, 11) and embedding of the prestressing means (12) so as to form prestressed concrete.

2. An air raid shelter as claimed in claim 1, in which the tubular concrete elements (10) are of substantially square or rectangular cross-section, and wherein the prestressing means (12) are arranged in the region of the corners of the concrete elements (10).

3. An air raid shelter as claimed in claim 1 or 2, wherein the tubular concrete elements (10) in their end surfaces have two defining flanges (29, 30) which protrude differently far and define an annular groove (31), the defining flange (29) closest to the stiffening beam (17, 18) of the concrete element being the shortest, while the adjoining concrete element has its longer defining flanges (30) placed close to each other in order to permit, on in situ concreting, introduction of concrete and reinforcement (25, 26) to form a locking tongue.

4. An air raid shelter as claimed in claim 3, wherein the stiffening beams (17) on the outer side of the concrete elements (10) having protruding lugs (20) for the fastening of forms for in situ concreting.

5. An air raid shelter as claimed in claim 3, wherein the peripheral edges of the end wall elements (11) are enclosed by reinforced in situ cast concrete (13) at least in the regions where the prestressing means (12) are anchored in the end wall elements.

6. An air raid shelter as claimed in claim 3, wherein the stiffening beams (17, 18) are also provided with holes (21), formed in the axial direction of the concrete elements (10, 11) to permit passing through said holes through reinforcing elements (27) of a non-tensioned reinforcement (24–27) for the in situ cast concrete (13).

7. An air raid shelter as claimed in claim 3, wherein the structure comprises several adjoining rooms each of which has a set of delimiting tubular concrete elements (10), the stiffening beams (17) on the tubular concrete elements of adjoining rooms being offset in relation to each other and engaging each other in a comb-like manner, and a longitudinal, reinforced stiffening beam of in situ cast concrete being formed at the top and optionally also at the bottom between adjoining sets of tubular concrete elements.

8. An air raid shelter as claimed in claim 3, wherein the tubular concrete elements (10) have internal strengthening means (22) in their corner regions.

9. An air raid shelter as claimed in claim 3, wherein the stiffening beams (17, 18) are arranged exteriorly at the top and at the sides of the tubular concrete elements (10) and are arranged interiorly at the bottom of the tubular concrete elements (10).

10. An air raid shelter as claimed in claim 3, wherein the air raid shelter contains stationary air raid shelter equipment and the equipment is arranged on and united with the end wall elements (11).

11. A building structure comprising a number of adjoining, prefabricated, reinforced tubular concrete elements and end wall elements clamped together with the aid of prestressing means, wherein each of the tubular concrete elements is of substantially square or rectangular cross-section and each of the tubular concrete elements has at least one exteriorly, interiorly or both exteriorly and interiorly protruding, reinforced stiffening beam integral with the remaining concrete element and having holes formed in the axial direction of the tubular concrete elements for the prestressing means to pass through, which prestressing means are arranged in the region of the corners of the concrete elements and are anchored to the end wall elements and serve to clamp together the tubular concrete elements between the end wall elements, and wherein interstices are formed between the stiffening beams of the joining concrete elements and said interstices are filled with reinforced in situ cast concrete for permanent interconnection of the concrete elements and embedding of the prestressing means so as to form prestressed concrete, and wherein the stiffening beams on the outer side of the concrete elements have protruding lugs for the fastening of forms for in situ concreting.

12. A building structure as claimed in claim 11 wherein the peripheral edges of the end wall elements are enclosed by reinforced in situ cast concrete at least in the regions where prestressing means are anchored in the end wall elements.

13. A building structure as claimed in claim 11 wherein the stiffening beams are also provided with holes formed in the axial direction of the concrete elements to permit passing through said holes through reinforcing elements of a non-tensioned reinforcement for the in situ cast concrete.

14. A building structure as claimed in claim 11 wherein the structure comprises several adjoining rooms each of which has a set of delimiting tubular concrete elements, the stiffening beams on the tubular concrete elements of adjoining rooms being offset in relation to each other and engaging each other in a comb-like manner, and a longitudinal, reinforced stiffening beam of in situ cast concrete being formed at the top and optionally also at the bottom between adjoining sets of tubular concrete elements.

15. A building structure as claimed in claim 11 wherein the tubular concrete elements have internal strengthening means in their corner regions.

16. A building structure as claimed in claim 11 wherein the stiffening beams are arranged exteriorly at the top and at the sides of the tubular concrete elements and are arranged interiorly at the bottom of the tubular concrete elements.

* * * * *